United States Patent [19]

Christensson

[11] 4,008,848

[45] Feb. 22, 1977

[54] CUP FORMED CONTAINER HAVING A LINING FOIL

[75] Inventor: Od Wikar Christensson, Stockholm, Sweden

[73] Assignee: Esseltepac Aktiebolag, Jarfalla, Sweden

[22] Filed: Nov. 24, 1975

[21] Appl. No.: 634,770

[30] Foreign Application Priority Data

Dec. 10, 1974 Sweden ..... 7415449

[52] U.S. Cl. ..... 229/31 R; 229/34 A; 229/14 BL; 229/3.5 MF

[51] Int. Cl.[2] ..... B65D 5/22; B65D 25/14

[58] Field of Search .... 229/3.5 MF, 14 BL, 14 BA, 229/30, 31 R

[56] References Cited

UNITED STATES PATENTS

| | | | |
|---|---|---|---|
| 597,731 | 1/1898 | Morrison | 229/31 R |
| 667,634 | 2/1901 | Schmidt | 229/24 |
| 917,962 | 4/1909 | Morrison | 229/31 R |
| 1,158,699 | 11/1915 | McCleery | 229/30 |
| 1,704,175 | 3/1929 | Coale | 229/3.5 MF X |
| 1,956,159 | 4/1934 | Reilly et al. | 229/14 BA |
| 1,965,138 | 7/1934 | Dunlap | 229/31 R X |
| 2,808,192 | 10/1957 | Rasin | 229/3.5 MF X |
| 3,035,735 | 5/1962 | Presnick | 229/30 X |
| 3,489,331 | 1/1970 | Andersson | 229/31 R X |

*Primary Examiner*—Davis T. Moorhead
*Attorney, Agent, or Firm*—Larson, Taylor and Hinds

[57] ABSTRACT

In a cup formed container formed from a plain punched blank of cardboard or the like laminated with an inner lining blank, the carton is formed by two opposite side pieces folded up from the bottom of the blank so as to form two opposite walls, the remaining two walls being formed by extended ends of the two side pieces and a joint flap, the joint flap being folded upwardly from the bottom, and the extended ends being folded upwardly and inwardly so as to lie adjacent the joint flaps. Two cooperating extended ends and a joint flap thus form the other walls, with the cooperating extended ends forming a joint between their opposing joining edges. The lining blank projects a distance radially outside the joint flaps and above the intended upper edge of the container, the projecting portion of the lining blank forming a projecting lining tongue which is folded over the upper edge of the walls and is attached to the outside of the container over the joint formed by the joining edges of the extended ends. Any gap between these joining edges thus is bridged over at least part of its height by the joining flap, and over at least part of its height by the folded lining tongue, which lies between the extended ends and the associated joint flap. This construction eliminates the tendency of the walls formed by the extended ends to buckle outwardly because of the weakness inherent in a wall formed by the two unconnected extended ends, particularly in the area of their joining edges.

9 Claims, 4 Drawing Figures

CUP FORMED CONTAINER HAVING A LINING FOIL

Figure 1:
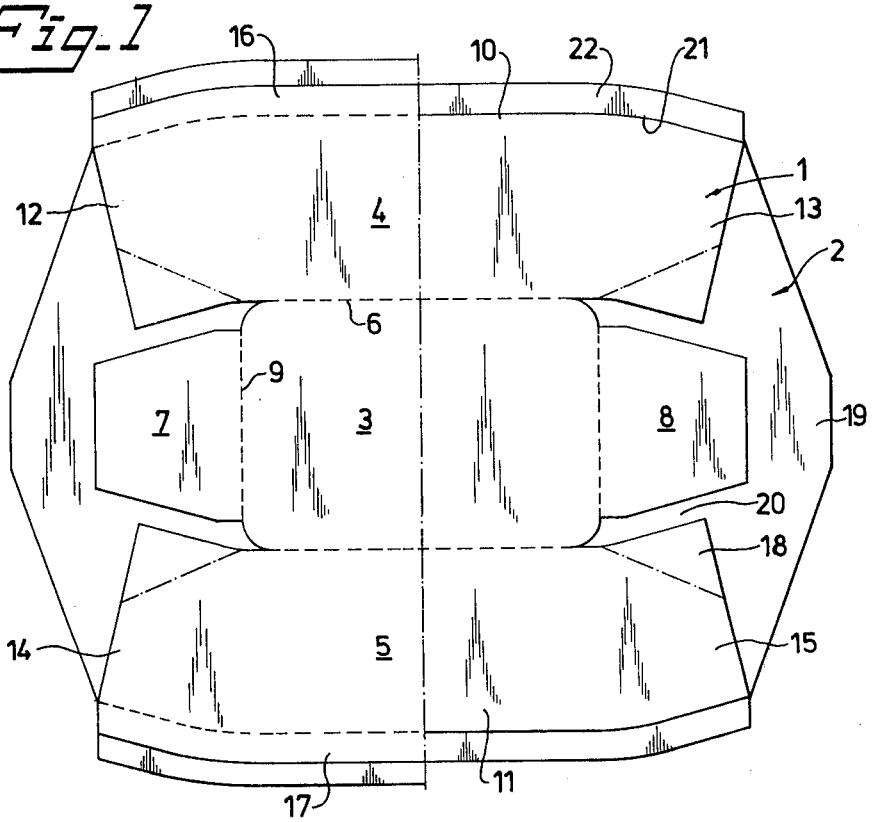

The present invention relates to a cup formed container preferably intended for packaging of paste formed products like margarine and similar products and being of the type which is formed of a continuous piece of cardboard material comprising bottom, two opposite side pieces which are coherent with the bottom and which are wider than the side of the bottom with which they hang together and two opposite joint flaps which are coherent with the bottom and the width of which is the same as or less than the side of the bottom with which they hang together.

Cup formed containers of the above mentioned type are previously known, which for the sake of sealing are provided with a separate lining which is loosely inserted in the container cup or which is deep drawn from a plastic material directly into the container cup. Generally the said linings are made of a plastic material with a relatively strong bending strength of its own, and therefore they give the container cup of the cardboard material a fairly good addition to the combined strength. Often the lining is provided so as to extend some distance down along the outside of the container cup, and sometimes it ends with a radially outwards directed flange which further increases the strength of the container.

Linings of plastic material are rather expensive, and it often involves cost consuming operations to provide a lining in the container cup. For these and other reasons it is therefore a wish to eliminate linings of plastic material and on the contrary to use linings of thinner and less expensive material. Such thin and generally easily formable linings however involve certain strength problems in conventional cardboard containers, and in containers of the above mentioned type, in which two sides are formed by the outermost parts of the wide container sides of the two opposite side pieces, there is the problem, that the container tends to bend outwards to angular form at the connection line between the two said outer parts of the wide containers sides.

The main object of the invention therefore is to provide a cup formed container of the above mentioned type, in which the lining forms an integral part of the outer container blank and is made of a thin and easily formable material, and in which parts of the lining foil of a ready container provide a stabilizing of the upper edge of the container and in particular of the above mentioned parts which tend to crack or bend outwards to angular form.

A further object of the invention is to provide a container in which the evenly cut edges of the cardboard material are protected from contact with the packed material or are located spaced from the upper edge of the container.

Further characteristics of the invention will be evident from the following detailed description in which reference will be made to the accompanying drawings. It is however to be understood that the following specification only includes illustrating examples of the invention, and that all kinds of modifications may be presented within the scope of the appended claims.

Figure 2:
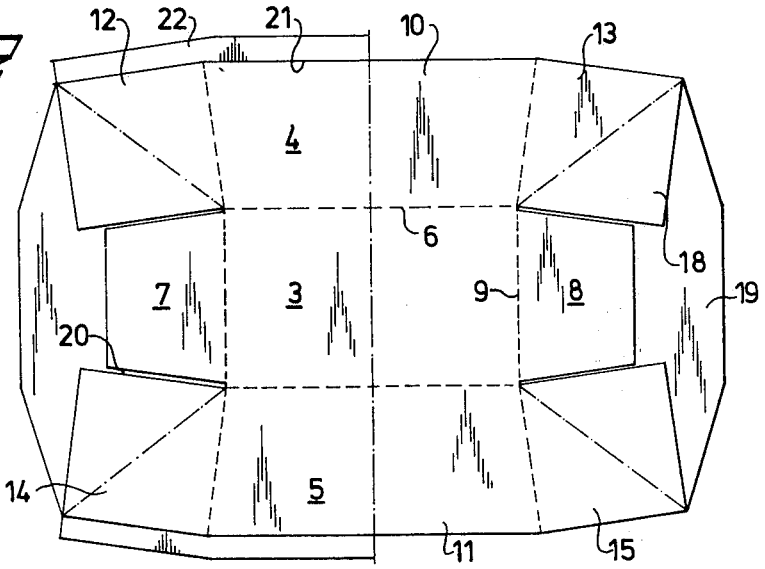
Figure 3:
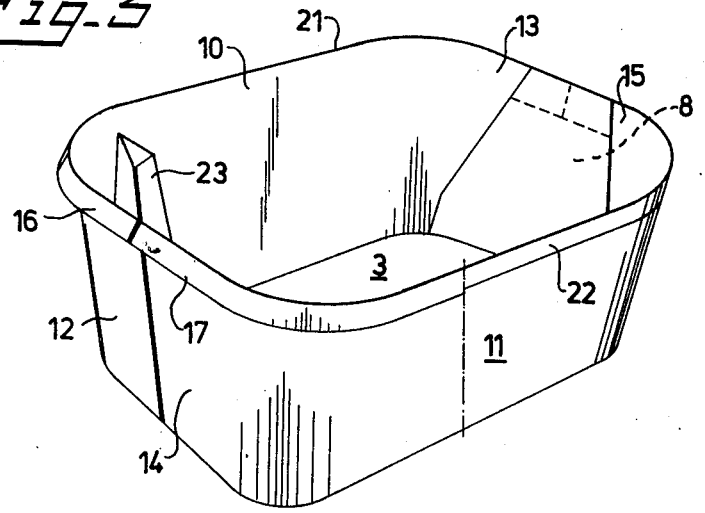
Figure 4:
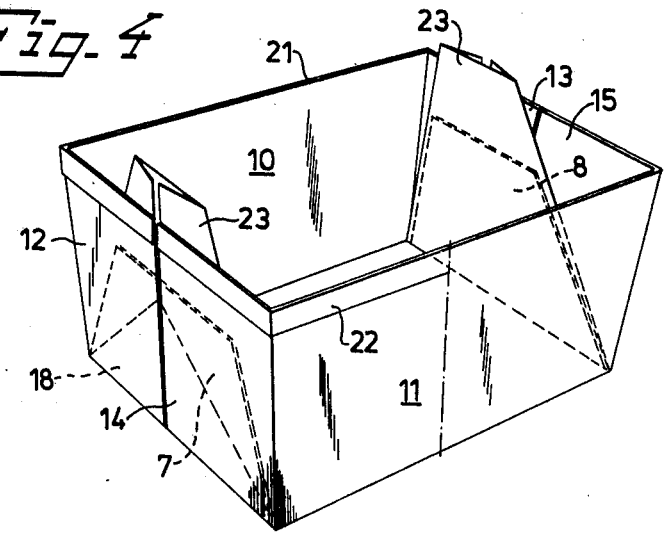

In the drawings FIG. 1 shows two alternative embodiments of a blank for a cup formed container according to the invention, and in the drawing one embodiment is shown in the left hand part of the figure, and the second embodiment at the right hand part. Correspondingly FIG. 2 shows two alternative embodiments of a blank for a container of a modified type. FIG. 3 shows an almost ready container provided by the blank according to FIG. 1, and FIG. 4 shows in the same way an almost ready container made of the blank according to FIG. 2.

The container blank shown in FIG. 1 comprises an outer container blank 1 of cardboard or similar stiff material and a lining blank 2 of a thin and easily formable material like paper, parchment, glassine, a thin metal foil, a metal foil laminated with paper or any similar material. Both the outer container blank 1 and the lining blank 2 are formed as a continuous piece of a plain, punched piece of material. The lining blank 2 is glued or laminated over substantially the entire surface of the outer container blank and it forms an integral part of the combined container blank.

The outer container blank comprises a bottom 3, two opposite side pieces 4 and 5 which are coherent with said bottom and which are wider than the width of the side 6 of the bottom with which they hang together, and two opposite joint flaps 7, 8 which are coherent with said bottom and the width of which is less than or the same as the side 9 of the bottom with which they hang together. Each side piece 4 and 5 includes a central side piece part 10 and 11 respectively which forms a complete side of the container and on each side of said central side piece part an outer side piece part 12, 13 and 14, 15 respectively. The outer side piece parts 12–15 suitably have a width which corresponds to the width of the adjacent side of the container, but they may depending on the circumstances be formed narrower or wider than the said dimension. Two opposite outer side piece parts 12, 14 and 13, 15 respectively are intended to form together the complete or a part of the intermediate side of the container, and they are intended to be completed and/or joined by the joint flaps 7 and 8.

In the left hand half of FIG. 1 a narrow edge strip 16, 17 is delimited along the outer edge of the cardboard blank, which strip is intended to form a downwards sloping edge flange of the ready container, which flange forms an angle to the container side. Such an edge flange increases the torsion strength of the container to a substantial degree.

As indicated above the lining blank 2 is glued or laminated over substantially the entire surface of the cardboard blank, but in order to make the erection of the cardboard blank possible without any special steps the corners of the outer side piece parts 12–15 turned to each other, e.g. the corner 18 are left unglued or unlaminated. In case the joint flap 7 or 8 is to be attached to the outside of the container also the said joint flap is left unglued or unlaminated to the lining blank.

The lining blank projects with a part thereof 19 outside the joint flaps 7 and 8, it bridges the slot between the joint flaps 7 and 8 on one hand and the outer side piece parts 12–15 on the other and extends up to the intended upper edge 21 of the container. The lining blank also projects with a narrow strip outside the cardboard blank and the said strip 22 is intended to be glued onto the outside of the container or the edge flange 16, 17 of the container. In order to avoid such stresses of the lining material, that the said material tends to brake, the edge flange 16, 17 of the cardboard blank may also be left unglued or unlaminated, and the lining strip 22 is not glued onto the edge flange 16, 17 until the container has already been erected.

The erection of the container blank shown in the right hand part of FIG. 1, which is seen from underneath, is performed by folding the joint flap 8 in towards the interior of the container, whereupon the outer side piece parts 13 and 15 are folded to round form and towards each other, and the lining is folded double and is put in between the joint flap 8 and the outer side parts 13 and 15. Concurrently with the erection of the side pieces 4 and 5 the lining strip 22 is folded to the outside of the container and is glued thereto. If wanted the joint flap 8 and the belonging parts of the lining may be glued onto the outer side parts 13 and 15. The lining part 19 forms an upwards projecting lining tongue 23 extending on both sides of the joint line between the outer side parts 13 and 15. The lining tongue 23 is finally folded down over the upper edge of the container and is glued onto the outside of the container.

Even with a relatively thin and soft lining material the lining strip 22 turned over and attached to the outside of the container provides a substantial stiffening of the said container, and the lining tongue 23 provides a very good stiffening action of the side of the container composed by the two outer side parts 13 and 15. The lining tongue 23 thereby prevents an angular bending outwards of that side of the container along the joint line between the outer side parts 13 and 15 which would otherwise occur due to the stretching of the cardboard material.

The container blank shown in the left hand half of FIG. 1 is basically erected in the same way as that of the right hand half, but the erection is started by folding the edge strips 16 and 17 at the same time as the container sides are fold up and the outer side parts 12, 14 and 13, 15 are fold in towards each other to form the rounded container corners. This continuous bending of the edge strips 16 and 17 and the container corners is necessary to avoid a breaking of the edge strips at the container corners. After the sides have been erected the lining strip 22 is folded in under the edge strips or flanges 16 and 17 and is glued onto the rear sides thereof. The lining tongue 23 is likewise folded in under and behind the edge flanges 16 and 17 and is attached by being glued.

Whereas FIG. 1 shows a container blank having rounded corners, FIG. 2 shows a container blank having sharp corners, but otherwise the container blanks are substantially identical. The left hand part of FIG. 2 shows a container blank, in which the lining projects outside the side pieces 4 and 5 with a strip 22, and the said strip is glued onto the outside of the container. In the right hand part of FIG. 2 is on the contrary shown how the lining extends edge to edge with the outer edges of the side pieces 4 and 5, whereby the lining will thus extend edge to edge with the upper edge of the container. In both cases the container is however stabilized by the projecting lining tongue 23 which is folded over the upper edge and is glued onto the outside of the container.

The above described embodiments of the invention are shown to have an upwards diverging conical form that gives an aesthetically attractive container which is besides advantageous in that containers may be piled within each other so as to provide little space. It is however to be understood, that the containers may as well be formed with parallel sides or with upwards converging cone form within the scope of the invention.

In case the joint flaps 7 and 8 are provided at the outside of the container, ears of the lining blank are folded in behind one lining side which to form and size substantially corresponds to the container side, whereupon the lining with the said lining ears are glued onto the outer side piece parts 12–15, and the lining tongue 23 is folded over the upper edge and is glued onto the outside of the container. This embodiment provides an inner surface which is almost completely smooth. The joint flaps is glued onto the outside of the container, i.e. onto the outer side piece parts before or after the lining tongue 23 is folded over the upper edge of the container.

In case the pairs of outer side piece parts 12–15 have a combined width which is less than the adjacent side of the container a slot is formed between the side edges thereof turned to each other and thereby the outer side piece parts are joined by means of the joint flaps 7 and 8. In such an embodiment the lining tongue 23 is of particular importance for the stiffening of the container.

I claim:

1. A cup formed container comprising an outer container made of a plain punched blank of cardboard or similar stiff material comprising a bottom, two opposite side pieces foldably connected with said bottom along opposite first and second edges thereof and forming first and second opposite walls, said side pieces being extended at their ends so as to be longer than said first and second edges with which they are foldably connected, the extended ends of said side pieces being folded upwardly and inwardly from the blank form to form at least in part third and fourth opposite walls, two opposite joint flaps foldably connected to opposite third and fourth edges of said bottom and folded upwardly to lie adjacent and opposite said extended ends of said side pieces and cooperate therewith in forming said third and fourth walls, said joint flaps being no longer than said third and fourth edges, and a unitary inner lining blank extending over substantially the entire surface of the outer container blank and adhered to at least the great majority of said surface to form an integral part of the combined container blank and the formed container, said lining blank having portions projecting a distance radially outside of said joint flaps and hence above the intended upper edge of the container, parts of said lining blank being folded in between each joint flap and its adjacent extended ends of said side pieces in said third and fourth walls, said projecting portions of said lining blanks forming projecting folded lining tongues which are folded over the upper edges of said third and fourth walls and attached to the outside surfaces of said third and fourth walls over the joining edges of said extended ends in said third and fourth walls.

2. A container according to claim 1 wherein cooperating pairs of extended ends of said side pieces have a combined length which is no greater than the length of the third or fourth wall in which they lie so that their joining edges do not overlap and any space between said edges is bridged by the cooperating joint flap over at least part of the height of the container wall, and is bridged by said folded lining tongue at least in the upper part of the container wall.

3. A container as claimed in claim 2 wherein said joint flaps, as folded upwardly, are of less height than said extended ends of said side pieces such that the joint flaps terminate short of the upper edges of said third and fourth walls.

4. A container as claimed in claim 1 wherein said joint flaps are centrally disposed along said third and fourth edges, but are of shorter length than said third and fourth edges so as to encompass only part of the length of said third and fourth sides.

5. A container as claimed in claim 1 wherein said joint flaps lie inwardly of said folded extended ends in said third and fourth walls.

6. A container as claimed in claim 1 wherein, in addition to said folded lining tongue, said lining blank is formed with a narrow strip extending around and over the upper edge of said container and adhered to the outside surfaces of the container walls.

7. A container as claimed in claim 1 wherein said container walls are formed with an edge flange extending downwardly along the container walls.

8. A container as claimed in claim 7 wherein, in addition to said folded lining tongue, said lining blank is formed with a narrow strip extending around and over the upper edge of the container, down along said edge flange, and under and behind said edge flange.

9. A container as claimed in claim 7 wherein said lining tongue is folded under and behind the edge flange and is attached to the rear side thereof.

* * * * *